United States Patent [19]

Adams

[11] Patent Number: 4,776,806

[45] Date of Patent: Oct. 11, 1988

[54] LOW-PROFILE CONNECTOR ASSEMBLY

[75] Inventor: John E. Adams, Mechanicsburg, Pa.

[73] Assignee: E. I. Du Pont de Nemours and Company, Wilmington, Del.

[21] Appl. No.: 71,800

[22] Filed: Jul. 10, 1987

[51] Int. Cl.[4] ..... H01R 9/09

[52] U.S. Cl. ..... 439/67; 439/77; 439/493

[58] Field of Search ..... 439/65, 67, 74, 76–78, 439/377, 493, 495, 498, 499, 876

[56] References Cited

U.S. PATENT DOCUMENTS

| | | | |
|---|---|---|---|
| 3,689,865 | 9/1972 | Pierini et al. | 339/17 L |
| 3,701,964 | 10/1972 | Cronin | 439/77 |
| 3,851,294 | 11/1974 | Palazzetti et al. | 439/67 |
| 3,915,535 | 10/1975 | O'Keefe et al. | 339/17 C |
| 3,963,319 | 6/1976 | Schumacher et al. | 339/176 |
| 4,005,921 | 2/1977 | Hadden et al. | 339/14 R |
| 4,157,612 | 6/1979 | Rainal | 439/493 |
| 4,358,172 | 11/1982 | Narozny | 439/65 |
| 4,406,512 | 9/1983 | Schell | 339/177 |
| 4,489,999 | 12/1984 | Miniet | 439/67 |
| 4,602,831 | 7/1986 | Lockard | 339/14 R |
| 4,605,276 | 8/1986 | Hasircoglu | 339/176 |
| 4,639,063 | 1/1987 | Mueller | 439/77 |
| 4,647,133 | 3/1987 | Renken et al. | 439/876 |
| 4,682,828 | 7/1987 | Piper et al. | 439/77 |

*Primary Examiner*—Gil Weidenfeld
*Assistant Examiner*—Paula A. Austin

[57] ABSTRACT

A connector is formed as a molded body having a sub-assembly that includes a terminal board aligned transverse to the longitudinal axis of the cable and an attached receptacle strip that includes an array of pin-receiving receptacles. The receptacles are secured at one end to the terminal board which also includes printed circuit wiring traces to facilitate electrical connection between the receptacles and the wire conductors of a ribbon cable. A frame is provided within the molded body and includes a base having an elongated slot formed therein and upstanding tabs at the opposite ends. The sub-assembly is positioned relative the slot so that the receptacle strip and its pin receptacles are in substantial registration with the slot. The frame and the terminal strip, as well as the end portion of the ribbon cable, are maintained in their assembled relationship by the molded body. The tabs each includes apertures for engaging a connector removing tool. In a multi-connector system in which a series of connectors are positioned in a longitudinally aligned and spaced apart relationship, the upstanding tabs of the second and successive connectors serve to receive and constrain the ribbon cables of the preceding connectors to provide a low-profile connection system that also provides a desirable measure of ribbon cable control.

18 Claims, 3 Drawing Sheets

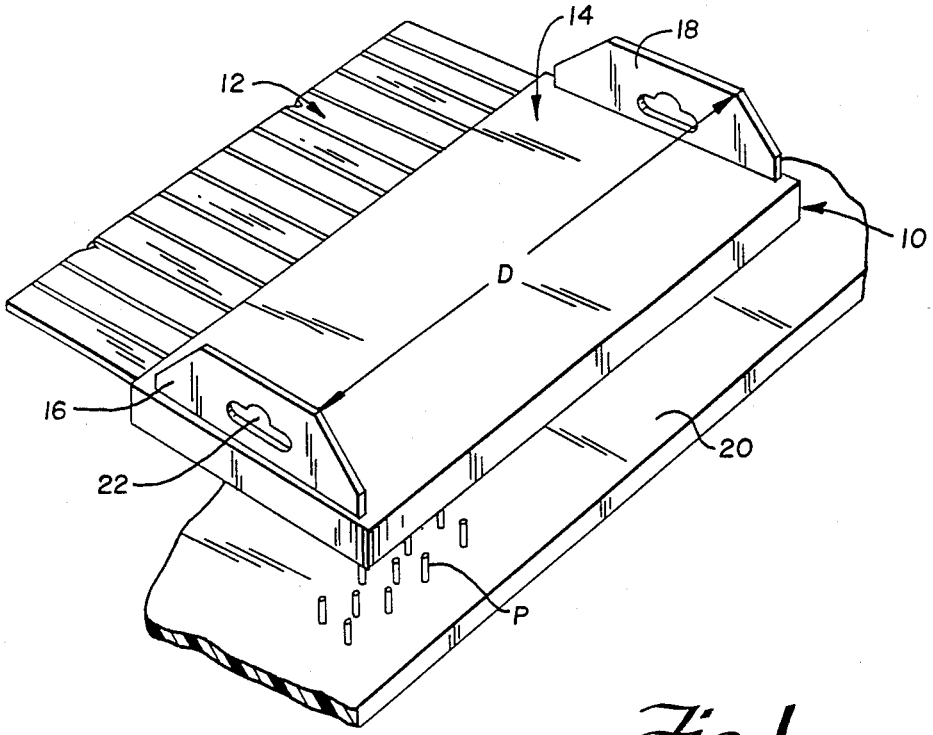
Fig. 1
Fig. 2
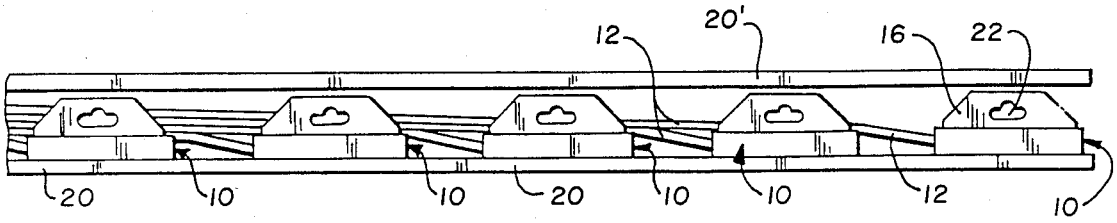

Fig. 3
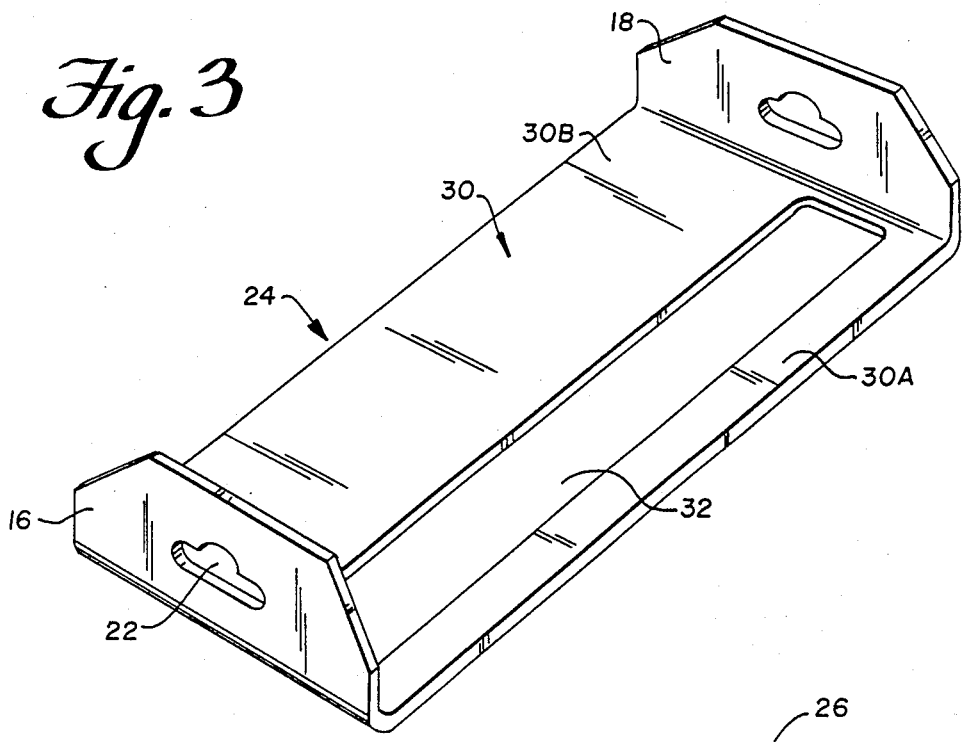
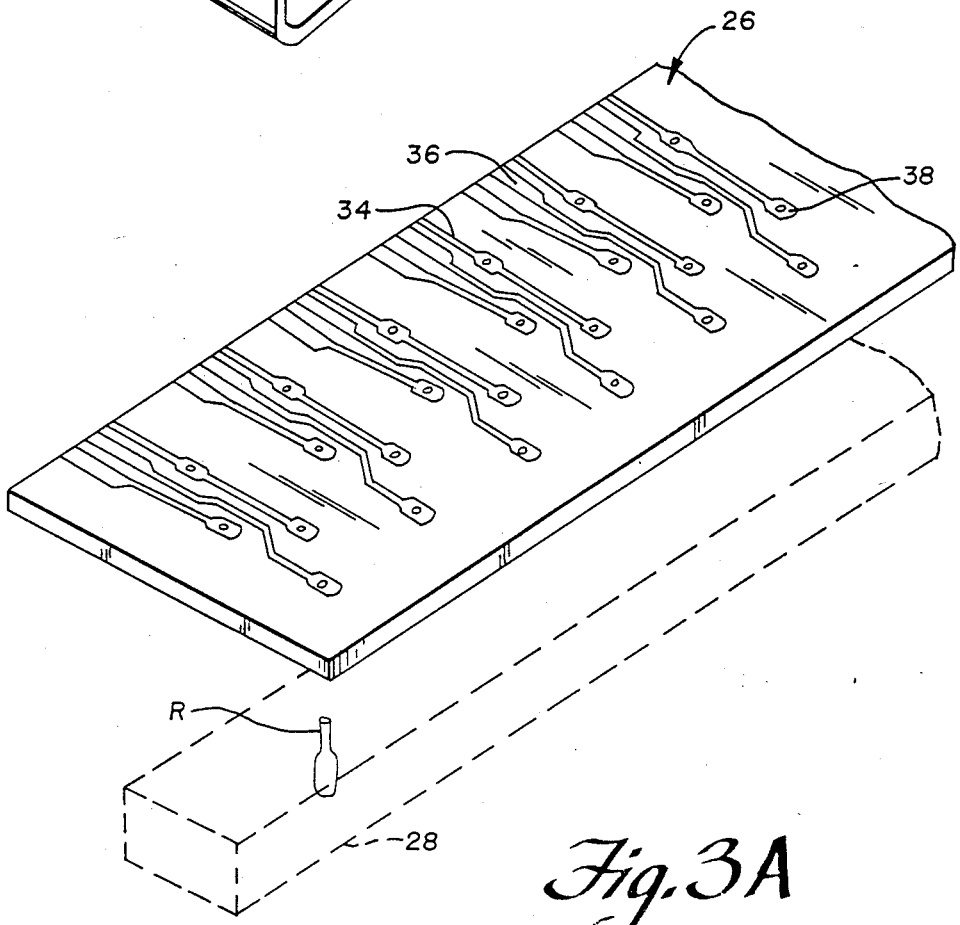
Fig. 3A

LOW-PROFILE CONNECTOR ASSEMBLY

BACKGROUND OF THE INVENTION

The present invention relates to electrical connectors and, more particularly, to an electrical connector assembly for connecting a cable assembly to a connector accepting substrate.

Various types of connectors and connection systems have been developed for connecting a multi-wire cable to a printed circuit board or other circuit-bearing substrate. In general, connectors have included complementary two-piece plug and receptacle combinations in which a receptacle is mounted on the surface of the printed circuit board and is designed to releasably engage a mating plug. Typically, the pin and sockets of the two components are configured for a straight-through type of engagement, that is, the principal axes of the pins and pin-receiving receptacles are in-line with that of the wires of the connected cable. In general, a two component plug and receptacle combination is an efficient type of interface, although it is oftentimes difficult to obtain a low-profile connection because of the presence of the receptacle mounted on the surface of the printed circuit board. Other connection schemes have used edge connection systems in which plural conductive traces on the surface of the printed circuit board are formed in a parallel spaced relationship perpendicular to an edge of the board. The edge of the printed circuit board is then engaged with a one-piece connector as used, for example, in 'cage' type mounting systems. This latter system does allow a low-profile connection, although the requirement to bring signal lines to an edge of the printed circuit board limits design flexibility, especially with larger and more complex printed circuit boards.

In addition to the problems associated with effecting a cable interconnection to a printed circuit board, the passage of the cabling runs between circuit boards can present a problem where a large number of cables are connected to closely spaced circuit boards. While various types of cable ties, lacing, and securements are known, inattention to cable placement can create problems where close board spacing is required.

Historically, the trend in circuit board packaging has been in the direction of closely stacked adjacent boards haing minimal inter-board spacing. While edge type connectors are consistent with minimum inter-board spacing and are particularly well suited for mounting printed circuit boards on a motherboard, for example, edge connection places constraints on the circuit designer by limiting, to some extent or the other, the total number of connections to those that can be brought to an edge. Traditional two-components plug/receptacle connectors can be mounted on the surface of the board and do not present the constraints imposed by edge connectors; however, the need to mount one of the components on the circuit board limits inter-board spacing.

SUMMARY OF THE INVENTION

In view of the above, it is an object of the present invention, among others, to provide a connector well-suited for connecting a wire cable to a printed circuit board.

It is another object of the present invention to provide a low-profile connector for connection to a printed circuit board in which the connector does not prevent the close spacing of adjacent printed circuit boards.

It is still another object of the present invention to provide a low-profile connector for connecting ribbon-type cables to a printed circuit board in which the connector can function as a cable guide for other ribbon-type cables.

In view of these objects, and others, the present invention provides a low-profile connector for connecting wire cables to a printed circuit board in which an efficient interconnection is achieved while permitting closely spaced board mounting in comparison to prior two-piece connection systems. The low-profile connector includes a plug body having a width co-extensive with its wire cable and formed from a moldable material. A receptacle strip having an array of contacts and a terminal board are contained within the plug body along with a frame that provides a measure of structural rigidity to the connector. The frame includes a face portion having an elongated slot through which upstanding pins on the surface of the printed circuit board extend to effect mechanical and electrical connection with the contacts of the receptacle strip. The frame includes upstanding tabs at its opposite ends with the spacing between the tabs sufficiently wide to serve as a cable guide for the cables of other connectors.

In a preferred embodiment of the present invention, the connector is formed as a molded body in which a flat ribbon cable is connected to a sub-assembly that includes a terminal board aligned transverse to the longitudinal axis of the cable and an attached receptacle strip that includes an array of pin-receiving receptacles. The receptacles are secured at one end to the terminal board which also includes printed circuit wiring traces to facilitate electrical connection between the receptacles and the wire conductors of the ribbon cable. A frame is provided with a base having an elongated slot formed therein and upstanding tabs at the opposite ends. The sub-assembly is positioned relative the slot so that the connector strip and its pin receptacles are in substantial registration with the slot. The frame and the connection block, as well as the end portion of the ribbon cable, are maintained in their assembled relationship by the molded plug body that surrounds the connector sub-assembly. The tabs each include an aperture for engaging a connector removal tool.

In a multi-connector system in which a series of connectors are positioned in a longitudinally aligned and spaced apart relationship, the upstanding tabs of the second and successive connectors in the series serve to receive and constrain the ribbon cables of the preceding connectors in the series to provide a low-profile connection system that also provides a desirable measure of ribbon cable control.

The present invention advantageously provides a low-profile connector assembly and connection system which allows the close, adjacent spacing of printed circuit boards and control of the associated cabling in a space and cost-efficient manner.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 1 is an isometric projection of a low-profile connector in accordance with the present invention positioned above an array of pin contacts extending upwardly from a printed circuit board;

FIG. 2 is a side view of two adjacent printed circuit boards with the lower-most board having a series of connectors of the type shown in FIG. 1 and in which the connectors also function as cable guides;

FIG. 3 is an isometric view of a frame structure for the connector of FIGS. 1 and 2.

FIG. 3 is an exploded perspective of a portion of a terminal board and receptacle strip (dotted line illustration) used in the connector of FIG. 1.

DESCRIPTION OF THE PREFERRED EMBODIMENT

Figure 4:
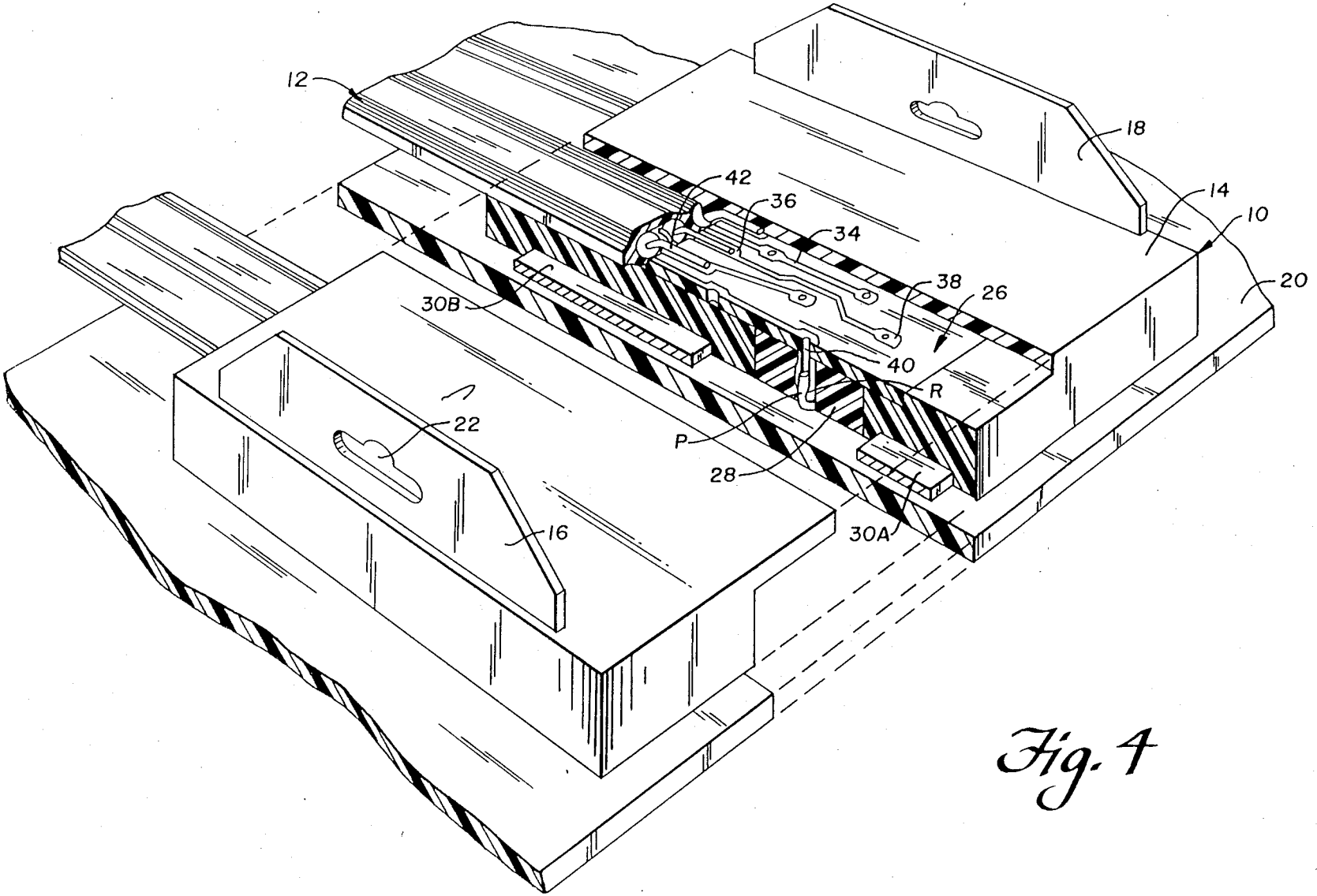
FIG. 4 is an enlarged isometric view of the connector of FIG. 1, in partial section, and in engagement with the pins of the printed circuit board.

A connector in accordance with the present invention is shown in FIG. 1 and designated generally therein by the reference character 10. As shown, the connector 10 terminates the end of a ribbon cable 12 of the type having a plurality of adjacent conductors aligned in a common plane. The connector 10 includes a body 14 having first and second tabs 16 and 18 extending upwardly at the opposite ends of the body 14. The body 14 is preferably formed as a parallelipiped from a moldable plastic and contains various sub-components described more fully below in relationship to FIGS. 3, 3A, and 4. The connector 10 is designed to engage a multi-row array of upstanding connector pins P mounted on a printed circuit board 20 by positioning the connector 10 above the connector pins P and pressing the connector 10 into engagement with the pins P until the bottom face of the connector 10 engages the corresponding surface of the printed circuit board 20. The tabs 16 and 18 are each provided with a respective through opening 22 which can be engaged by a connector removal tool (not shown). In the preferred embodiment, the through openings 22 are each defined as an elongated slot aligned in the longitudinal direction of the ribbon cable 12 with a semi-circular cut-out on the upper side thereof.

The tabs 16 and 18 are spaced apart from one another by a dimension D (FIG. 1) that is larger than the lateral width dimension of the ribbon cable 12. When the connectors 10 are used in a multi-connector application, the tabs 16 and 18 can be used as a cable guide. For example and as shown in FIG. 2 a series of connectors 10 are linearly aligned in a spaced apart relationship between two printed circuit boards 20 and 20'. The ribbon cable 12 from the first connector 10 in the series, on the right in FIG. 2 is laid to the left through the upstanding tabs 16 and 18 of its immediately adjacent connector 10 with each successive connector 10 accommodating and guiding the ribbon cable 12 of the first connector 10. Accordingly, the tabs 16 and 18 of a particular connector 10 function as a cable guide for the preceding connectors 10 in the series. In this manner, the connector 10 functions to provide an electrical connection with the printed circuit board 20 as well functioning as a cable guide for the ribbon cables 12 of other connectors 10.

As shown in the exploded view of FIGS. 3 and 3A and the assembled view of FIG. 4, the body 14 contains a frame 24, a terminal board 26, and a receptacle strip 28. The frame 24 is formed from a pressed or stamped metal sheet (e.g., aluminum or steel) and, as shown in FIG. 3, includes a base 30 and the above-described tabs 16 and 18 at its opposite ends. A slot-like opening 32 is formed in the base 30 to define a forward sub-base 30A and a rearward sub-base 30B. The slot-like opening 32 has a lateral width dimension somewhat less than the dimension between the tabs 16 and 18. The terminal board 26, as shown in FIG. 3A, is a conventional printed circuit board and includes conductive traces 34 and associated pads 36 for connection to the conductive leads 42 (FIG. 4) of the ribbon cable 12 as well as pads 38 for connection to pin-receiving receptacles R as described below. In addition to the conductive traces 34 shown in FIG. 3A, the opposite surface of the terminal strip 26 (not shown) can include a conductive pattern to define a ground plane, for example. The receptacle strip 28, as best shown in FIG. 4, includes a plurality of through bores (unnumbered) containing respective dual-beam receptacles R. Each receptacle R includes a pin 40 that extends into its associated through bore and is soldered in place to its connection pad 38. In general, the principal axes of the receptacles R are perpendicular to the plane of the terminal strip 26 and the connected conductive leads 42 of the ribbon cable 12.

The components shown in FIG. 3 and FIG. 3A are assembled as shown in FIG. 4, that is, the receptacle strip 28 and its receptacles R are mounted to the terminal strip 26 with the proximate ends of the receptacles R soldered to their respective conductive pads 38. The end of the ribbon cable 12 is prepared by stripping appropriate lengths of the outer jacketing and insulating sheaths (unnumbered) to expose the conductive leads 42 which are then soldered to their respective pads 36. The terminal board 26 and the attached receptacle strip 28 constitutes a sub-assembly which is positioned between the tabs 16 and 18 of the frame 24 with the receptacle strip 28 in general registration with the slot-like opening 32. With the components maintained in this position, the body 14 is molded in the general form of a low-profile parallelipiped with the tabs 16 and 18 extending upwardly as shown in FIGS. 1 and 4. As best shown in FIG. 4, the body 14 is formed to capture a portion of the insulating jacket of the ribbon cable 12 and the receptacle strip 28 is positioned to extend through the slot-like opening 32 between the forward and rearward sub-bases 30A and 30B to allow direct face-to-face contact with the printed circuit board 20. Molding can be accomplished using a multi-part mold with suitable plastics including polyphenylene sulfide.

The connector 10 of the present invention provides a low-profile connector that permits convenient connection to a printed circuit board without the need for a socket or similar component to be mounted to the board and in which the distance that the connector 10 extends above the board is relatively small. For example, in the preferred embodiment, the dimension between the top of the tabs 16 and 18 and the underside of the completed connector 10 is less than 0.75 inches with 0.62 inches being typical, and the dimension between the top and underside of the molded body is less than 0.25 inches with 0.22 inches being typical. Accordingly, the present invention allows for a relatively small inter-board spacing in those design applications, as represented in FIG. 2, where a plurality of printed circuit boards are mounted in a close, adjacent relationship. Additionally, the tabs 16 and 18 allow a designer to use a series of connectors in a linearly spaced relationship with the tabs of the succeeding connectors in the series functioning as a cable guide or constraint for the cables of the preceding connectors in the series. In the disclosed embodiment, the connector 10 has been described as terminating a flat, ribbon type cable and using pin-receiving receptacles R in the receptacle strip 28 for engaging cylindrical pins P mounted on the printed circuit board. As can be appreciated, other types of cables having a defined lateral or cross-sectional dimension can be terminated by the connector and other types of contacts, including triple-beam receptacles, square pins, and contacts of the blade and bifurcated fork type, are likewise suitable.

Thus it will be appreciated from the above that as a result of the present invention, a highly effective low-profile connector assembly is provided by which the principal objectives, among others, are completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims and their legal equivalent.

What is claimed is:

1. A connector for connecting a multi-wire cable having a cross-sectional dimension with a circuit bearing substrate of the type having an array of electrical contacts, the connector comprising:

a connection strip having an array of contacts therein;

a terminal board engaging said connection strip and to which a proximate end of each of said contacts of the connection strip is secured, said terminal board having means for connecting respective ones of said contacts of said connection strip to a wire of the cable;

a mounting frame having a base and upstanding tabs at the opposite ends thereof, said frame having an opening though the base thereof in registration with the contacts of said connection strip; and a plug body surrounding and containing said connection strip, terminal board, and at least a portion of said frame.

2. The connector of claim 1, wherein the spacing between said upstanding tabs is larger than the cross sectional dimension of the cable.

3. The connector of claim 1, wherein said upstanding tabs are formed with apertures therein for engaging a connector removal tool.

4. The connector of claim 1, wherein said contacts of said connection strip are of the dual-beam receptacle type.

5. The connector of claim 1, wherein said connecting means of said terminal board comprises a plurality of conductive traces, each of said traces having a connection pad for a one of said contacts of said connection strip and a connection pad for at least one conductive lead of the cable.

6. A connector for connecting a multi-wire ribbon cable having a lateral dimension with a printed circuit board of the type having a plurality of upstanding pin-like contacts normal to the plane of the board, the connector comprising:

a frame having a laterally extending base and an upstanding tab at the opposite ends of said base, said base having a laterally extending opening therein;

a connection block having an array of contacts of a first type mounted therein for engagement with an array of respective pin-like contacts, said connection block aligned substantially transversely to the longitudinal direction of the cable and in substantial registration with the laterally extending opening of said base;

a terminal strip engaging said connection block and to which a proximate end of each of said contacts of the first type is secured, said terminal strip having means for connecting respective ones of said contacts of the first type to a wire of the cable; and a plug body in the form of a parallelipiped formed about said connection block, terminal strip, and the base portion of said frame, said tabs extending upwardly from said plug body.

7. The connector of claim 6, wherein the spacing between said upstanding tabs is larger than the lateral dimension of the cable.

8. The connector of claim 6, wherein said upstanding tabs are formed with apertures therein for engaging a connector removal tool.

9. The connector of claim 6, wherein said terminal strip has conductive electrical traces on at least one side surface thereof connected to respective ones of said contacts of the first type and for connection to a respective wire of the cable and conductive traces on the opposite side thereof for connection to other wires of the cable.

10. The connector of claim 6, wherein said contacts of the first type are pin-receiving sockets.

11. The connector of claim 10, wherein said contacts of the first type are dual-beam pin-receiving receptacles.

12. A multi-connector system for connecting at least first and second longitudinally extending ribbon cables to first and second longitudinally spaced arrays of electrical contacts on a circuit bearing substrate, the ribbon cable of the first connector constrained by the second connector, the system comprising:

a first connector for connecting a first ribbon cable to a first array of electrical contacts on a circuit bearing substrate, said first connector having a connection body aligned transverse to its ribbon cable and containing contacts therein for electrical engagement with the first array of electrical contacts, said connection body having upstanding tabs at the opposite ends thereof, the lateral spacing between the upstanding tabs greater than the lateral width of said first ribbon cable; and at least one other connector for connecting another ribbon cable to another array of electrical contacts on the circuit bearing substrate longitudinally spaced from said first array, said other connector having a respective connection body containing contacts therein for electrical engagement with the other array of electrical contacts and upstanding tabs at the opposite ends thereof, the lateral spacing between the upstanding tabs greater than the lateral width of the first-mentioned ribbon cable, the first-mentioned ribbon cable aligned and guided between the laterally spaced tabs of the said other connector.

13. The multi-connector system of claim 12, wherein each of said connectors comprises:

a frame having a laterally extending base and an upstanding tab at the opposite ends of said base, said base having a laterally extending opening therein;

a connection block having an array of contacts of a first type mounted therein for engagement with an array of electrical contacts on a circuit bearing substrate, said connection block aligned substantially transversely to the longitudinal direction of the cable and in substantial registration with the laterally extending opening of said base;

a terminal strip engaging said connection block and to which a proximate end of each of said contacts of the first type is secured, said terminal strip having means for connecting respective ones of said contacts of the first type to a wire of the cable; and a plug body formed about said connection block, terminal strip, and the base portion of said frame, said tabs extending upwardly from said plug body.

14. The connector of claim 13, wherein said upstanding tabs are formed with apertures therein for engaging a connector removal tool.

15. The connector of claim 13, wherein said terminal board comprises a plurality of conductive traces, each of said traces having a connection pad for a one of said contacts of said first type and a connection pad for at least one conductive lead of the cable.

16. The connector of claim 13, wherein said contacts of the first type are pin-receiving sockets.

17. The connector of claim 16, wherein said contacts of the first type are dual-beam pin-receiving receptacles.

18. A multi-connector system for connecting a series of longitudinally extending ribbon cables and their connectors to longitudinally spaced arrays of electrical contacts on a circuit bearing substrate, the ribbon cable of the first connector constrained and guided by the second and successive connectors of the series, the connectors of the system each comprising:

a connection body aligned transverse to its ribbon cable and containing contacts therein for electrical engagement with its respective array of electrical contacts, said connection body having upstanding tabs at the opposite ends thereof, the lateral spacing between the upstanding tabs greater than the lateral width of said ribbon cable to accommodate the ribbon cable of at least one other connector of the series of connectors.

* * * * *